United States Patent [19]

Takahashi et al.

[11] Patent Number: 4,577,951

[45] Date of Patent: Mar. 25, 1986

[54] PROCESSING SOLUTION TANK WITH HINGED SECTIONS

[75] Inventors: Yutaka Takahashi; Hiroshi Matsuoka, both of Kanagawa, Japan

[73] Assignee: Fuji Photo Film Co., Ltd., Kanagawa, Japan

[21] Appl. No.: 652,995

[22] Filed: Sep. 21, 1984

[30] Foreign Application Priority Data

Sep. 28, 1983 [JP] Japan ..... 58-150080[U]

[51] Int. Cl.[4] ..... G03D 13/04; G03D 3/13

[52] U.S. Cl. ..... 354/331; 354/322

[58] Field of Search ..... 354/316, 320, 321, 322, 354/331, 333, 335, 336, 337, 338; 134/64 P; 206/203, 197, 198

[56] References Cited

U.S. PATENT DOCUMENTS

| | | | |
|---|---|---|---|
| 42,061 | 3/1864 | Anthony | 354/331 |
| 2,503,308 | 4/1950 | Wiener et al. | 354/331 |
| 3,076,401 | 2/1963 | Djadjich | 134/64 P |
| 4,423,947 | 1/1984 | Jelinek et al. | 354/320 |

FOREIGN PATENT DOCUMENTS

| | | | |
|---|---|---|---|
| 1495745 | 12/1977 | United Kingdom | 354/331 |

*Primary Examiner*—A. A. Mathews

*Attorney, Agent, or Firm*—Sughrue, Mion, Zinn, Macpeak and Seas

[57] ABSTRACT

A processing solution tank specifically adapted for an office-type microfilm processing apparatus in which the operation of changing the processing solutions is eased. The tank is divided into two sections, each of which is composed of plural processing vessels. The two sections are joined together by a hinge so that they can be folded together. A carrying handle is fitted to the main body of each of the two sections, and the two handles come together when the tank is folded. The height of the handles is such as to prevent the processing solutions in the two sections from mixing with one another.

6 Claims, 6 Drawing Figures

PROCESSING SOLUTION TANK WITH HINGED SECTIONS

BACKGROUND OF THE INVENTION

The present invention relates to a tank for holding a processing solution which is adapted for use with an apparatus for processing a light-sensitive material such as a photographic film or a photographic paper. More particularly, the invention is concerned with the structure of a processing solution tank for use in a processing apparatus, especially an office-type processing apparatus, which is designed so that the tank can be easily attached to and removed from the apparatus. The use of such a tank makes easier the handling of processing solutions such as a developer, fixer, and washing water.

A micro camera processor is often used in an office document processing apparatus in which, for storage of documents, necessary information is photographed on microfilm and the microfilm is then subjected to photographic processing. Referring to FIG. 1, there is shown a schematic cross-sectional view of a photographic processing section of such a micro camera processor. A processing solution tank 1 is divided into four compartments, a developing compartment A, a fixing compartment B, a first water-washing compartment C, and a second water-washing compartment D, by three partitions 2, 3, and 4. Each compartment is charged with a specific processing solution. For holding and conveying the microfilm, processing racks 5, 6, 7 and 8 are attached to the corresponding compartments. An exposed film F is conveyed from the first processing rack 5 to the fourth processing rack 8 by a feed roller 11, a nip roller 10, a drum 9, and a feed roller 12, whereby the film is subjected to the desired processing.

In processing apparatuses of this type, when a certain amount of film has been processed and the processing solution is exhausted, it is necessary to renew the processing solution. To do this, the processing solution is exchanged by removing the racks 5, 6, 7 and 8 from the processing solution tank 1, or alternatively, by removing the processing solution tank 1 from the racks 5, 6, 7 and 8 and thereafter pulling the processing solution tank 1 toward the front of the processing apparatus.

However, problems are encountered in handling the processing solution tank filled with the processing solution. That is, when the processing solution tank of the structure as described above, which is filled with processing solution, is removed from the processing apparatus and transferred, since the processing solution tank is rectangular in form and is relatively unstable, the processing solution often spills from the processing solution tank, thereby fouling the inside of the processing apparatus or the room.

SUMMARY OF THE INVENTION

Accordingly, an object of the present invention is to provide a processing solution tank which overcomes the above-described problems encountered in using conventional processing solution tanks and which is improved in handling.

In accordance with the above and other objects, the present invention provides a processing solution tank for a processing apparatus having a plurality of processing vessels separated from each other by partitions, improved in that the main body of the processing solution tank is designed to be foldable so that the processing vessels can be divided into two groups or sections, and a carrying handle is fixed to the main body of each of the two divided sections, the height of the carrying handle being such that the processing solutions in the processing vessels are prevented from mixing with each other.

DESCRIPTION OF THE PREFERRED EMBODIMENTS

The present invention will hereinafter be explained in detail with reference to the accompanying drawings.

Figure 1:
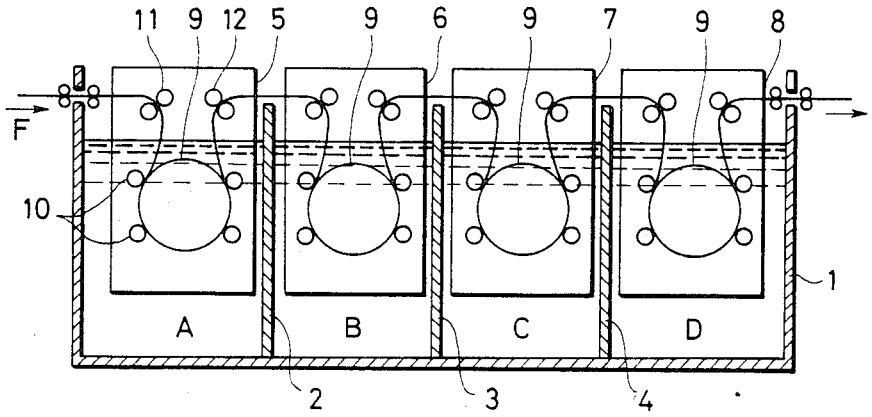
FIG. 1 is a schematic cross-sectional view of a conventional processing solution tank.
Figure 2:
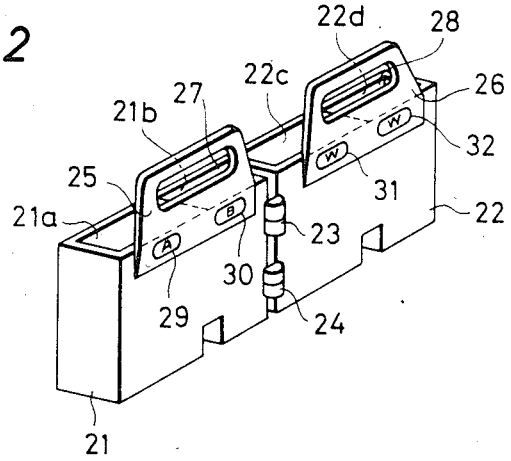
FIG. 2 is a perspective view of a preferred embodiment of a processing solution tank of the present invention.

FIG. 2 is a perspective view of a preferred embodiment of a processing solution tank of the present invention. This processing solution tank is composed of two sections 21 and 22 connected together by hinges 23 and 24 so that the sections 21 and 22 can be folded one on the other. The section 21 includes two processing compartments 21*a* and 21*b*, and the section 22, two processing compartments 22*c* and 22*d*. The sections 21 and 22 are fitted with carrying handles 25 and 26, respectively. These processing compartments 21*a*, 21*b*, 22*c*, and 22*d* correspond, respectively, to the compartments A, B, C and D shown in FIG. 1.

Figure 3:
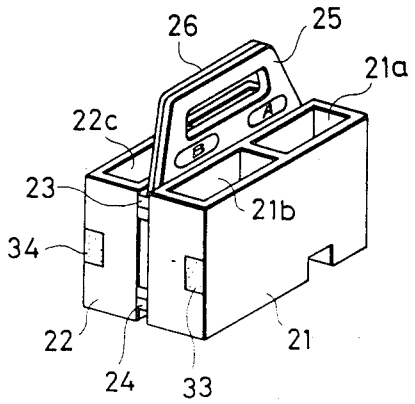
FIG. 3 is a perspective view illustrating the state in which the processing solution tank of the present invention is conveyed.

The handles 25 and 26, as can be seen from FIGS. 2 and 3, are fitted to the front of each of the sections 21 and 22. The handles includes grip holes 27 and 28 formed as relatively high plate-like members. Labels 29, 30, 31 and 32 are attached to the handles in order to indicate the type of the processing solution in each processing chamber.

FIG. 3 is a perspective view showing the state where the processing solution tank of FIG. 2 is folded in such a manner that the handles 25 and 26 are in contact with each other. Holders 33 and 34 are attached to the sections 21 and 22, respectively, so that when the processing solution tank in the state of FIG. 3 is unfolded, they are secured in the state shown in FIG. 2. In this embodiment, the holders 33 and 34 can be so-called "magic" tapes, magnets, or the like.

The processing solution tank of the present invention is placed in the processing apparatus in the form shown in FIG. 2 and carried in the form shown in FIG. 3.

The processing solution tank is usually folded while placed on the floor. Suitable means may be provided to reduce the contact resistance between the bottom of the processing solution tank and the floor. For example, a part of the bottom of the processing solution tank can be raised, or the bottom of the processing solution tank provided with rollers.

Figure 4:
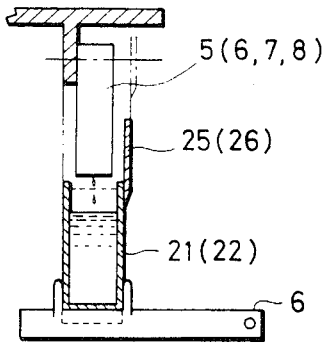
FIG. 4 is a sectional side elevation showing the state in which the processing solution tank of the present invention is attached to a processing apparatus.

FIG. 4 is a sectional side elevation illustrating the state where the processing solution tank 21 (22) of the present invention is attached to the processing apparatus 41. The processing solution tank 21 (22) is mounted on a guide rail 40 of the tank drawing mechanism of the processing apparatus so that the processing solution tank can easily be attached to and removed from the processing apparatus. If, in this state, the processing solution tank 21 (22) is lowered, although the processing solution may have a tendency to spill from the racks 5, (6, 7 and 8) into the processing solution tank and splash, because the handles 25 and 26 are in a relatively high plate-like form, they prevent this from happening. Moreover, in the case that the processing solution tank is folded as shown in FIG. 3 and conveyed, the handles 25 and 26 serve to prevent the processing solutions in the two sections 21 and 22, that is, the processing solutions in the compartments 21*a*, 21*b* and in the compartments 22*b*, 22*d*, from mixing.

In renewing the processing solution, usually the exhausted processing solution is discarded, the processing compartments 21*a*, 21*b*, 22*c*, and 22*d* washed, and the processing solution tank conveyed in the state in which only the water-washing compartments 22*c* and 22*d* are filled. In this case, if the processing solution tank were rectangular in form as shown in FIG. 1, it would be difficult to convey since the processing solution tank is unbalanced. In the case of the processing solution tank of the present invention however, the above problem is overcome since the tank can be folded as shown in FIG. 3.

Figure 5:
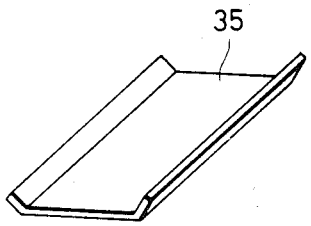
FIG. 5 is a perspective view of a float which may be used with the invention.

When a float 35 in the form shown in FIG. 5 is placed in each processing chamber of the processing solution tank, scattering of the processing solution during the time of conveying the processing solution tank can be prevented more effectively. It is desirable for the float 35 to be made, for instance, of an expanded polyurethane material so that it can float on the processing solution. If the float 35 is molded in a traylike form with the central potion thereof concave, it serves to direct the flow of the processing solution, and therefore the processing solution can be discarded more easily.

Figure 6:
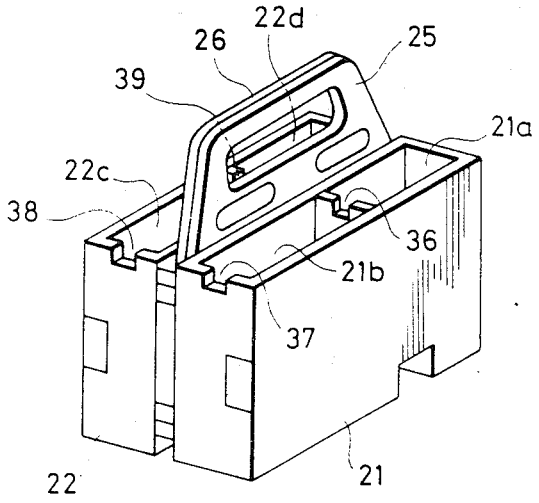
FIG. 6 is a perspective view of another embodiment of a processing solution tank of the present invention.

Further, as shown in FIG. 6, the partitions of the processing solution tank may be provided with notches 36, 37, 38, and 39 for discharge of the processing solution. These notches also facilitate the discharge of the processing solution.

The present invention, as described above, relates to a processing solution tank for a processing apparatus having a plurality of processing vessels separated from each other by partitions, wherein the processing solution tank is made foldable so that the processing vessels can be divided into two groups, and a carrying handle is fitted to the main body of each of the divided two sections, the height of the carrying handle being such that the processing solutions in the processing vessels are prevented from mixing with each other. Thus, the present invention provides a processing solution tank having greatly improved handling characteristics.

We claim:

1. In a processing solution tank for a lightsensitive material-processing apparatus having a plurality of processing vessels separated from each other by partitions, the improvement wherein said processing solution tank is divided into two sections hingedly connected to one another, and a carrying handle is fitted to a main body of each of said sections, said handle having a solid portion such that processing solutions in said two sections are prevented from mixing with each other when said sections are folded into abutment.

2. The processing solution tank of claim 1, wherein adjacent ends of said sections adjacent the hinged connection therebetween are provided with holding means for holding said sections together when unfolded into alignment with each other.

3. The processing solution tank of claim 1, further comprising at least one float for a respective one of said processing vessels.

4. The processing solution tank of claim 3, wherein said float has a concave center portion.

5. The processing solution tank of claim 1, wherein upper ends of at least one of said partitions and end walls of said tank are provided with a pouring notch.

6. The processing solution tank of claim 1, further comprising label means provided on said carrying handles for identifying solutions contained in respective ones of said vessels.

* * * * *